US006463688B1

(12) United States Patent
Idehara

(10) Patent No.: US 6,463,688 B1
(45) Date of Patent: Oct. 15, 2002

(54) BEAN BAG BATON

(75) Inventor: Russell Idehara, Hilo, HI (US)

(73) Assignee: Less Lethal, Inc., Los Angeles, CA (US)

( * ) Notice: Subject to any disclaimer, the term of this patent is extended or adjusted under 35 U.S.C. 154(b) by 0 days.

(21) Appl. No.: 09/594,926

(22) Filed: Jun. 15, 2000

Related U.S. Application Data

(60) Provisional application No. 60/140,010, filed on Jun. 18, 1999, now abandoned.

(51) Int. Cl.[7] ..... F41A 3/58; F41A 19/54

(52) U.S. Cl. ..... 42/1.16; 42/69.01; 42/26

(58) Field of Search ..... 42/69.01, 1.16, 42/26, 36, 38; 89/27.11

(56) References Cited

U.S. PATENT DOCUMENTS

| | | | | | |
|---|---|---|---|---|---|
| 1,994,294 | A | | 3/1935 | Williams, Jr. | |
| 2,042,934 | A | * | 6/1936 | Gill | 42/1.09 |
| 2,076,927 | A | | 4/1937 | Weber | |
| 2,124,172 | A | * | 7/1938 | Wildes et al. | 42/1.16 |
| 3,241,259 | A | | 3/1966 | McBride | |
| 3,364,817 | A | | 1/1968 | Barton | 89/1.813 |
| 3,385,601 | A | | 5/1968 | Black | 273/84 |
| 3,710,720 | A | | 1/1973 | Mawhinney | |
| 3,728,809 | A | | 4/1973 | Mulich et al. | 42/13 |
| 3,934,877 | A | | 1/1976 | White | 273/84 |
| 3,944,226 | A | | 3/1976 | Starrett | 273/84 |
| 4,203,599 | A | | 5/1980 | Starrett | |
| D273,216 | S | | 3/1984 | Sinrod | D22/1 |
| 4,644,930 | A | | 2/1987 | Mainhardt | 42/16 |
| 4,667,958 | A | | 5/1987 | Raitto | 264/259 |
| 4,690,404 | A | | 9/1987 | Yoder | 446/213 |
| 5,041,951 | A | | 8/1991 | Fan | 362/102 |
| 5,160,140 | A | | 11/1992 | Starrett | 403/109 |
| D333,693 | S | | 3/1993 | Parsons | D22/117 |
| D334,790 | S | | 4/1993 | Jaramillo | |
| D347,156 | S | | 5/1994 | Starrett et al. | D8/333 |
| 5,320,348 | A | | 6/1994 | Starrett | |
| 5,364,097 | A | | 11/1994 | Lyon | 42/1.16 |
| 5,388,361 | A | | 2/1995 | Farr | 42/1.16 |
| D359,338 | S | | 6/1995 | Starrett | D22/117 |
| D361,199 | S | | 8/1995 | Taylor | D3/226 |
| 5,450,795 | A | | 9/1995 | Adelman | 102/444 |
| 5,529,300 | A | | 6/1996 | Frazier et al. | 124/56 |
| D386,299 | S | | 11/1997 | Starrett | D3/229 |
| D386,612 | S | | 11/1997 | Starrett | D3/229 |
| D395,069 | S | | 6/1998 | Starrett | D21/117 |
| 5,898,125 | A | | 4/1999 | Mangolds et al. | 102/439 |
| 5,924,229 | A | | 7/1999 | Brice | 42/1.15 |

* cited by examiner

*Primary Examiner*—Stephen M. Johnson
(74) *Attorney, Agent, or Firm*—Fulbright & Jaworski LLP

(57) ABSTRACT

The Less Lethal (TM) police baton invention, which is capable of firing projectiles, is presented. The baton has a front barrel body, a rear breech body pivotally coupled to the front barrel body, a handle perpendicularly secured to the rear breech body, a locking mechanism adapted to lock the front barrel body to the rear breech body. It also has a firing mechanism positioned inside the rear breech body and adapted to trigger explosions of the projectiles. It has a safety trigger mechanism coupled to the firing mechanism, the trigger mechanism being adapted to be positioned horizontally for locking. The trigger can be unlocked and positioned vertically for triggering wherein a pulling stop of the firing mechanism is adapted to be urged forward by the trigger mechanism for triggering the firing mechanism.

16 Claims, 7 Drawing Sheets

10
74
116
114
112
14
26
34
32
64
20a
38a
18
A
A
B
B
29
36a
22a
30a
16
24

205
14°
.375
204
203

200
201
207
206
202

BEAN BAG BATON

This application claims the benefit of the provisional patent application No. 60/140,010 filed Jun. 18, 1999 now abandoned.

FIELD OF THE INVENTION

The present invention relates generally to a weapon system, and more particularly to a police baton having a firing mechanism capable of firing nonlethal in a situation where the use of force is required (the ability to fire less-lethal projectiles in an effort to control combative suspects. Although this invention is called the Bean Bag Baton, the device is not limited to firing bean bag munitions. The Bean Bag Baton is designed to fire various types of less-lethal projectiles).

BACKGROUND OF THE INVENTION

There are situations where law enforcement officers or military personnel are required to use force to control an armed or combative suspect. This device was invented to provide an alternative for law enforcement officers or military personnel to handle such situations. The purpose of the Bean Bag Baton is to minimize great bodily and/or fatal injuries to the suspect, and to increase safety for law enforcement officers or military personnel.

Traditionally, the only options available are a firearm, chemical agents, baton or club, or their fist. Whenever the firearm is used there is a distinct possibility that results could be fatal. The use of chemical agents is not always effective because of various reasons which include but are not limited to the dispensing canister being out of order or the law enforcement or military personnel who deployed the chemical agents becoming gassed. Use of the baton can result in great bodily injuries. However, trauma and/or pain have always been preferred to a fatal outcome. The use of pain compliance holds, punches, or kicks, causes the law enforcement or military personnel to unnecessarily physically engage the suspect. Many times the physical engagement results in the escalation of force, which often leads to the use of deadly force.

Currently, the law enforcement officers deploy kinetic less-lethal munitions by using a shoulder weapon. The shoulder weapon is usually a shotgun or rifle. During routine patrols, law enforcement or military personnel do not normally carry a shoulder weapon. When the law enforcement officers make a determination that a situation tactically necessitates the use of a less-lethal kinetic option, the officers are required to go back to their vehicles to secure a shotgun or a specially designated shotgun to deploy the less-lethal munitions. In some cases, officers do not have any less-lethal option available to them in their vehicles. They must request for a unit to respond to their location with less-lethal kinetic options. Not having the less-lethal kinetic options immediately available on the person of the initial responding officers limits their options to control the suspects.

The bean bag baton can minimize the risk of injury to both the law enforcement or military personnel and the suspects. The Bean Bag Baton is designed to deploy less-lethal munitions. The less-lethal projectiles are impact kinetic type munitions. The Bean Bag Baton is portable and is capable of being on the immediate person of law enforcement officers at all times. The Bean Bag Baton is also used as a regular baton.

In close range combat situations, batons or billy clubs, rather than rifles or hand guns, are commonly used by law enforcement officers or by military personnel to prevent unnecessary fatalities. Many types of conventional batons or billy clubs are commercially available. For instance, a police baton having an elongated barrel and a handle positioned at about one-fourth (¼) of the overall longitudinal length from a rear end is probably the most commonly used basic shape of all conventional police batons currently available on the market. Based on this basic design, variations and/or features are added thereon to provide a greater functionality to the conventional police batons.

Frazier et al. (U.S. Pat. No. 5,529,300) discloses a self-powered extensible projectile launching police baton. The '300 patent has a hollow telescopic ram or bolt member that is shorter than a barrel or trunk portion of the baton and is positioned within the barrel of the baton. The ram member can be driven out of the barrel of the baton by a source of gas under pressure. Thus, the ram member is extendible and fully retractable within the barrel of the baton. An explosive cartridge is mounted within the barrel near a rear end for providing a pressing force of the gas. A front tip of the extensible ram is purposely made blunt or is encircled by a thick deformable object to reduce the impact when the extensible ram hits an object or a person, thereby reducing the possibility of serious injury or fatality to any person.

Lyon (U.S. Pat. No. 5,364,097) discloses a police baton having an integral projectile launcher. The '097 patent has a main elongate body and a cross-handle perpendicularly coupled to the main body similar to the most common design of the conventional baton. The '097 baton's main elongated body includes a launching barrel and a breech end, which houses a firing mechanism and a recessed trigger for launching a projectile positioned within the launching barrel. The '097 police baton is capable of "firing" "less-lethal" projectiles or tear gas to subdue violent crowds in a distance of tens of meters away. To fire the '097 patent baton, a user has to insert his finger into a hole of a trigger position on the breech end and pull the trigger backward.

SUMMARY OF THE INVENTION

This invention, the Bean Bag Baton is an apparatus that can shoot a projectile out of itself. It has a barrel part, which holds the projectile. It has a breech part, which contains a firing mechanism. Pressing frontward a pulling stop of the firing mechanism triggers the firing mechanism. A trigger is attached to the firing mechanism to operate it. The breech body part of the invention has a handle that is affixed to it perpendicularly. The breech body part and the barrel body part are attached to each other so they can pivot relative to one another.

The foregoing and additional features and advantages of this present invention will become apparent by way of non-limitative examples shown in the accompanying drawings and detailed description that follow. In the figures and written description, numerals indicate the various features of the invention, like numerals referring to like features throughout for both the drawing figures and the written description.

BRIEF DESCRIPTION OF THE DRAWINGS

The above and other features and advantages of the invention will be more apparent from the following detailed description wherein.

DETAILED DESCRIPTION OF THE INVENTION

Figure 1:
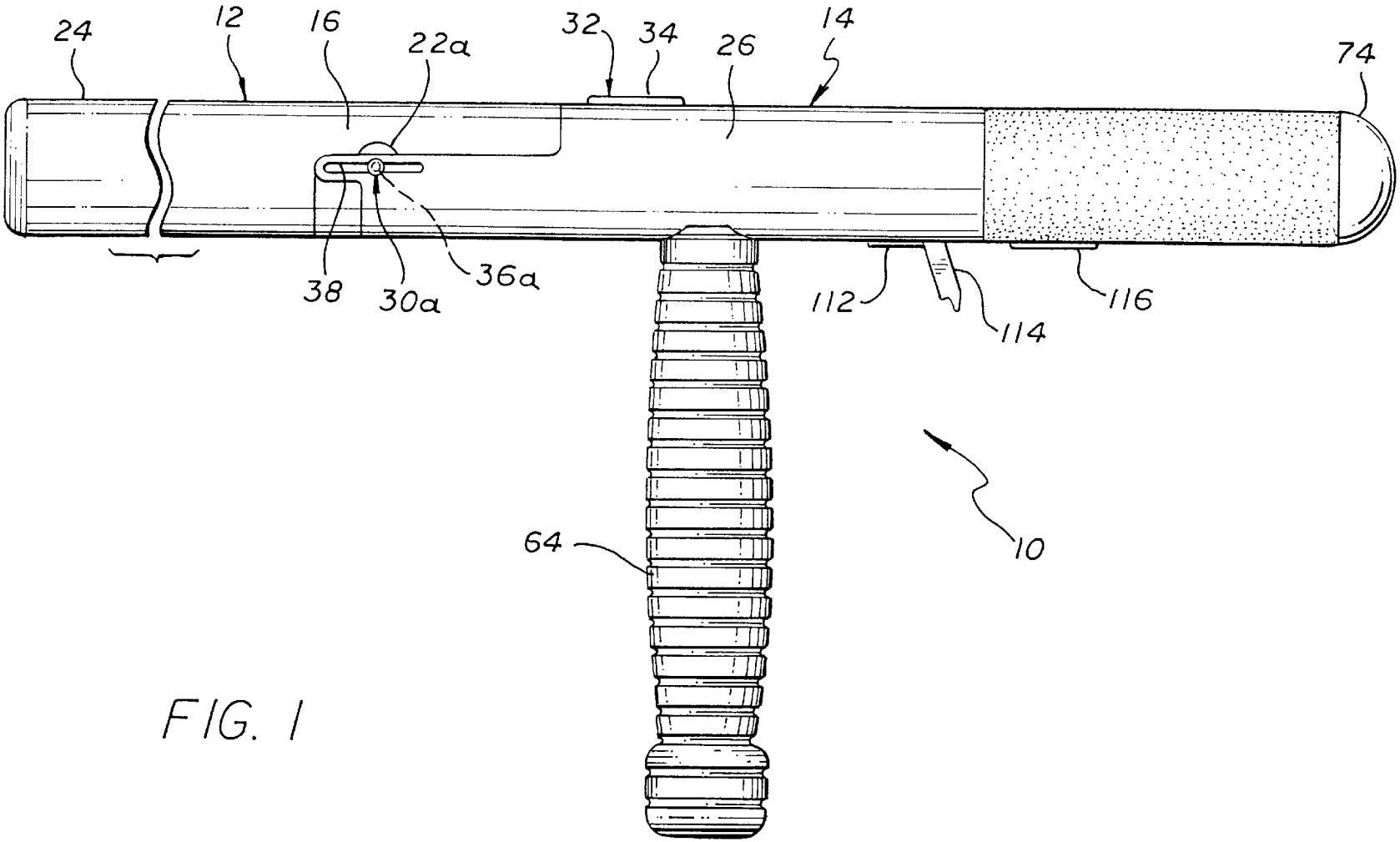
FIG. 1 shows a plan view of the baton according to the present invention.

The following description is of the best mode presently contemplated for carrying out the invention. This description is not to be taken in a limiting sense, but is merely made for the purpose of describing the general principles of the invention. The scope of the invention should be determined with reference to the claims.

In an aspect of the invention, the Bean Bag Baton is a baton weapon capable of firing projectiles to some 30 feet more, or less, depending upon the particular "less-lethal" munition chosen, such as a "bean bag". An aspect of the present invention is a highly desirable safety firing mechanism that prevents accidental triggering of the firing mechanism. Advantageously, the trigger feature of the firing mechanism combines a safety stop which must be pushed forward to operate the trigger. This design is safe and convenient during an emergent combat or confrontational situation. The trigger plate can be unlocked with a thumb, finger or part of the hand. It pops out of the locked position. Again using a thumb, a finger, or part of the hand the trigger plate is pushed into a perpendicular position and can then be pushed forward to fire the munition. Advantageously, aspects of the invention, the Bean Bag Baton, combine ease of use, easily going from baton striking action to munition firing action and back without providing accidental firing situations of the munition when being used as a thrusting or clubbing baton. Advantageously, law enforcement personnel wearing gloves can conveniently operate the invention.

An aspect of the present invention is a barrel body that can be opened by pivoting the barrel body relative to the breech body by some angle, typically about 90°, and that can be loaded thusly with a "less-lethal" projectile. The rear-end of the barrel body slides into or is pulled out of the breech body. The barrel body has an outer tubular member and an inner tubular member. The inner tubular member extends outward toward the rear of the barrel body. A sliding hinging system allows for the barrel body to pull out of the breech body and pivot toward a perpendicular relative position. There is a locking mechanism coupled to the breech body, which latches the barrel body to the breech body when the rear end section of said barrel body is slidably inserted into the front-end section of the breech body. Both contacting surfaces of the locking mechanism are hardened, typically by heat treatment of the metal.

When the barrel body is open relative to the breech body, a munition may be inserted into the barrel from the breech end. The barrel body is inserted back into the breech body and the barrel is locked to the breech body. The munition end, which is inserted toward the firing pin, typically, contains a powder charge. When the baton is fired, the charge integral with the munition determines the basic velocity and distance the munition may travel. The characteristics of the barrel and the angle of firing the gun also help determine the distance the munition travels and its velocity upon impacting a target or other object.

The Bean Bag Baton can minimize the risk of injury to both the law enforcement personnel as well as the suspect(s) or police opponent(s) compared to the law enforcement use of a handgun. This bean bag baton is designed to deploy "less-lethal" munitions. The "less-lethal" projectiles are impact kinetic type munitions. The bean bag baton is portable and is capable of being on the immediate person of law enforcement officers at all times. The bean bag baton is also used as a regular baton.

Aspects of this invention include a barrel body, a breech body which is coupled to the rear-end of the barrel body at the breech body's front end by a sliding hinging system, a handle perpendicularly coupled to the breech body, a firing mechanism positioned within the breech body and adapted to be triggered by pressing forward a pulling stop of the firing mechanism. The trigger mechanism is coupled to the firing mechanism and adapted to be positioned horizontally to be locked out of the way and not subject to accidental firing. The trigger mechanism is adapted to be positioned perpendicular to the barrel body. The trigger mechanism is adapted to be positioned perpendicularly to the barrel and breech body for conveniently pressing the pulling stop forward to trigger the firing mechanism.

FIG. 1 illustrates a preferred embodiment of this bean bag baton 10 invention. In FIG. 1, the baton 10 includes a front barrel body 12 pivotally coupled to a rear breech body 14 near a rear end of the front barrel body 12. Thus, the front barrel body 12 is adapted to be pivotally released, up to approximately 90°, from the rear breech body 14 of the baton 10 for loading or unloading projectiles within the baton 10. In this preferred embodiment, both the front barrel body 12 and the rear breech body 14 are made of aircraft grade aluminum materials. Thus the construction of this bean bag baton 10 invention is lightweight but hard and strong. Alternatively, in another embodiment of this invention, other suitable materials, such as non-aircraft grade aluminum, wood, plastic, or stainless steel, may be used to construct the bean bag baton 10.

Figures 2, 2A, 2B:
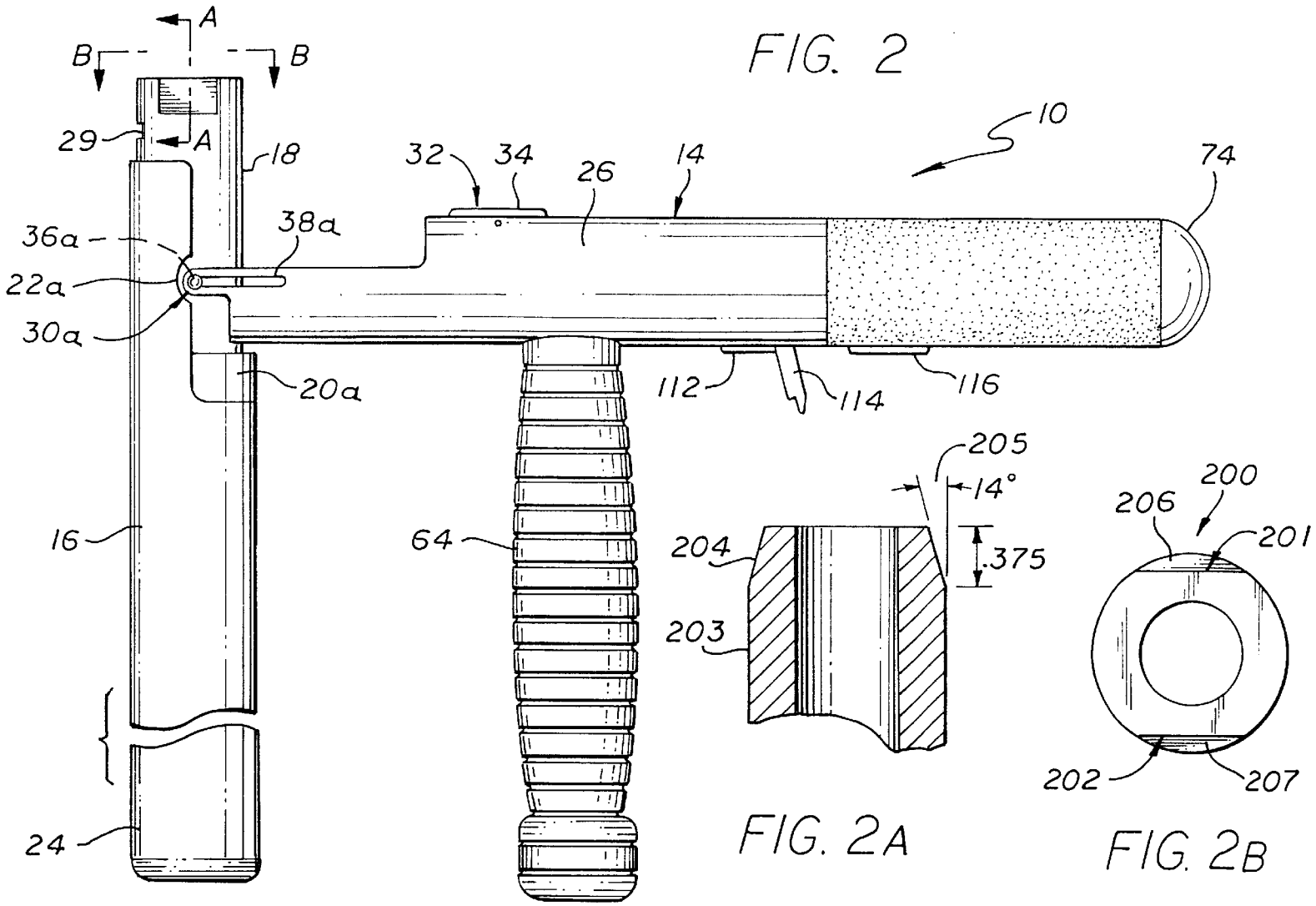
FIG. 2 shows the baton of FIG. 1 in an unlocked and open position for loading.

The front barrel body 12 is tubularly shaped and includes an outer tubular member 16 and an inner tubular member 18 securely coupled to an inner wall of the outer tubular member 16 (FIG. 2). The outer tubular member 16 is approximately 16 inches long and has an outer diameter of approximately 1.3 inches and an inner diameter of approximately 1 inch. The inner tubular member 18 is longer than the outer tubular member 16 by approximately fifteen-sixteenth ($^{15}/_{16}$) inch, and it has an outer periphery diameter of approximately 1 inch and an inner periphery diameter of approximately 0.8 inch. The front ends of both the outer and inner tubular members 16, 18 are even with respect to each other. Thus, the inner tubular member 18 extends approximately $^{15}/_{16}$ inch rearward out of the outer tubular member 16 at the rear end. The front end of the front barrel body 12 is machined to have a rounded or blunt edge for safety reason. For instance, the outer tubular member 16 has a rounded rim at an outer edge of its front end. Similarly, the inner tubular member 18 has a rounded rim at an inner edge of its front end. The rounded rims of both the outer and inner tubular members 16, 18 respectively have a radius of approximately one-eighth ($^{1}/_{8}$) inch, and the juncture of the outer and inner tubular members 16, 18 at the front end is made flat. By making the front end blunt, no person or object would, thus, be accidentally cut by the bean bag baton 10 due to a sharp edge at its front end. Furthermore, a rounded edge at the front of the bean bag baton 10 also reduces the severity of possible injuries that might occur to a person hit by the bean bag baton 10.

A lower half of the outer tubular member 16 extending forward of approximately 2 inches from its rear end is removed to form a semicircular portion at an upper rear part of the outer tubular member 16, as shown in FIG. 2. On opposite sides, left and right, from the center toward a lower half of the outer tubular member 16, approximately additional 0.5 inch horizontally forward from a cutoff line and approximately 0.5 inch vertically down from a center line of the outer tubular member 16 are also removed, FIG. 2. Thus, a roughly rectangular recess 20*a*, 20*b* (not shown) is respectively formed at the left and right lower sides of the outer tubular member 16 at approximately 2–2½ inches from its rear end. The rectangular recesses 20*a*, 20*b* (not shown) are adapted to house two connecting hinges 30*a*, 30*b* (not shown) respectively extending forward at opposite sides, left and right, from the rear breech body 14 when the front barrel body 12 and the rear breech body 14 are locked together. The hinges 30*a*, 20*b* (not shown) are disposed so as to be on the centerline of the front barrel body 12 as that centerline extends through the rear breech body 14. The upper front corners of each rectangular recess 20*a*, 20*b* (not shown) is roundly shaped, allowing the hinges 30*a*, 30*b* (not shown) of the rear breech body 14 to rotate or to move smoothly during locking or unlocking the front barrel body 12 with the rear breech body 14. The radius of the roundly shaped upper front corner of each recess 20*a*, 20*b* (not shown) is approximately of three-eighth (⅜) inches. In addition, two arch-shaped recesses 22*a*, 22*b* (not shown) are carved out of the outer tubular member 16 along longitudinal bottom edges at opposite sides of its cutoff semicircular portion, as shown in FIGS. 1 & 2. The arch-shape recesses 22*a*, 22*b* (not shown) each have a radius of approximately one-fourth (¼) inch, and extend approximately 0.06 inches deep into the outer tubular member 16 from their respective bottom edge. Moreover, each radius center of the arch-shape recesses 22*a*, 22*b* (not shown) is longitudinally displaced of approximately 1.325 inches from the rear end of the outer tubular member 16. Similar to the roundly shaped corners of the rectangular recesses 20*a*, 20*b* (not shown), the arch-shape recesses 22*a*, 22*b* (not shown) provide room for the pair of hinges 30*a*, 30*b* (not shown) of the rear breech body 14 to rotate freely during locking or unlocking the front barrel body 12.

A straight groove 24 approximately 0.05 inch wide and 0.03 inch deep is machined on the apex of the outer surface of the outer tubular member 16. The groove 24 extends through the outer tubular member 16 from the read end to the front end. The groove 24 functions as an aiming indicator to help the user aim the bean bag baton 10 at a selected target. In the preferred embodiment, the groove 24 is painted in white, as compared to a black surface color of the outer tubular member 16, for improving the contrast between the straight groove 24 and the outer surface of the baton 10. In other alternative embodiments, the groove 24, the outer surface of the front barrel body 12, and an outer surface of the rear breech body 14 may be painted with different colors other than the white and black.

As noted, the inner tubular member 18 of the front barrel body 12 is longer than the outer tubular member 16 of the front barrel body 12 by approximately 15/16 inch. Like its counterpart, the rear breech body 14 also includes an outer tubular part 26 and an inner tubular part 28 adapted to be securely inserted into the outer tubular part 26. In the preferred embodiment, the inner tubular member 18 and the outer tubular member 16 of the front barrel body 12 may be made of one piece of tube element. Likewise, the inner tubular part 26 and the outer tubular part 28 of the rear breech body may be made of one piece. In alternative embodiments, the inner and outer tubular members 16, 18 of the front barrel body 12 or the inner and outer tubular parts 26, 28 of the rear breech body 14 may be respectively made of separate tube elements. The outer tubular part 26 is approximately ten and a half inches (10½) long and has a same outer periphery diameter and a same inner periphery diameter as of the outer tubular member 16 of the front barrel body 12. Contrary to the inner tubular member 18 of the front barrel body 12, the inner tubular part 28 of the rear breech body 14 is short than the outer tubular part 26 of the rear breech body 14. The inner tubular part 28 is approximately six and a half (6½) inches long and has a same outer periphery diameter and a same inner periphery diameter as of the inner tubular member 18 of the front barrel body 12. The inner tubular part 28 extends forward from the rear end of the rear breech body 14. Thus, the approximately 4 inches of the front end of the rear breech body 14 has only the outer tubular part 26 and no inner tubular part 28. As a result, the rear end of the inner tubular member 18 of the front barrel body 12 is adapted to be inserted into and interlocked with the rear breech body 14 at the front side for better securing the front barrel body 12 and for providing adding strength when used as a baton.

A transverse groove 29 approximately 0.25 inch long and 0.06 inch deep is formed on the outer surface of the inner tubular member 18 approximately 0.55 inch longitudinally from the rear end of the inner tubular member 18. The transverse groove 29 is adapted to lock a seesaw lock 34 of a locking mechanism 32 positioned on the top of the rear breech body 14. Two pivot knobs 36*a*, 36*b* (not shown) are securely mounted on the opposite sides (left and right) of the lower half of the inner tubular member 18 respectively. The pivot knobs 36*a*, 36*b* (not shown) are respectively positioned approximately at the radius center of the respective arch-shape recesses 22*a*, 22*b* (not shown). The pivot knobs 36*a*, 36*b* (not shown) are cylindrically shaped and have an outer diameter of approximately 0.15 inch. Each pivot knob 36*a* or 36*b* (not shown) extends out of the surface of the inner tubular member 18 of approximately 0.1875 inch. The pivot knobs 36*a*,5 36*b* (not shown) are adapted to hinge on the respective extended hinges 30*a*, 30*b* (not shown) of the rear breech body 14, as will be explained in further detail later. In the preferred embodiment, the pivot knobs 36*a*, 36*b* (not shown) each comprise a cylindrical bolt adapted to be screwed into a receptive screw hole of the inner tubular member 18 positioned at about the radius center of the respective arch-shape recesses 22*a*, 22*b* (not shown).

As mentioned above, the outer tubular part 26 of the rear breech body 14 has the same diameters, both of the outer and inner peripheries, as the outer tubular member 16 of the front barrel body 12. Therefore, the rear extended portion of the inner tubular member 18 of the front barrel body 12 is adapted to be inserted into the front end of the outer tubular part 26 of the rear breech body 14. Moreover, approximately 2 inches longitudinally of the front upper half of the rear breech body 14 is removed, leaving the rear breech body 14 of a semicircular shape at its front lower half Consequently, the upper semicircular half of the outer tubular member 16 of the front barrel body 12 could mesh properly with the lower semicircular half of the outer tubular part 26 of the rear breech body 14, while the rear end of the inner tubular member 18 of the front barrel body 12 is inserted into the rear breech body 14 for locking.

A pair of pivoting hinges 30*a*, 30*b* (not shown) are integrally positioned at the front upper ends of the lower half of the rear breech body 14 at opposite sides, as shown in FIG. 2. The pivoting hinges 30*a*, 30*b* (not shown) are approximately 1.25 inches long and extend approximately 0.5 inch forward out of a front edge of the semicircular section of the lower half of the rear breech body 14. Thus, the pivoting hinges 30*a*, 30*b* (not shown) are adapted to mesh respectively with the cutoff rectangular recesses 20*a*, 20*b* (not shown) of the outer tubular member 16 of the front barrel body 12. The pivoting hinges 30*a*, 30*b* (not shown) have a generally elliptic-shape sliding slot 38*a*, 38*b* (not shown) of approximately 1.325 inches long horizontally and 0.16 inch wide vertically. The pivoting hinges 30*a*, 30*b* (not shown) of the rear breech body 14 receives the pivot knobs 36*a*, 36*b* (not shown) of the front barrel body 12 within the sliding slots 38*a*, 38*b* (not shown). Therefore, the pivot knobs 36*a*, 36*b* (not shown) are adapted to slide laterally within the sliding slots 38*a*, 38*b* (not shown) of their respective pivoting hinges 30*a*, 30*b* (not shown). The upper and lower front corners of each pivoting hinge 30*a*, 30*b* (not shown) are machined to smooth rounded shapes. The roundly shaped front corners of the pivoting hinges 30*a*, 30*b* (not shown) have a radius of approximately three-sixteenth (3/16) inch, which corresponds to the upper front corner of the rectangular recesses 20*a*, 20*b* (not shown) and the arch-shape recesses 22*a*, 22*b* (not shown). As a result, the front barrel body 12 and the rear breech body 14 may be pivotally rotated approximately 90° with respect to each other when unlocked. The rear approximately 3.5 inches of the surface of the rear breech body 14, until about 0.375 inch away the rear end of the rear breech body 14, is made rough to enable the user a better grip of the baton 10.

Referring to FIG. 2, a mechanism 200, 201, 202 is incorporated into the inner barrel 18 to aid in the removal of a spent round. The rim of the spent round may be grasped by the tips or nails of two fingers. A slot 206,207 is disposed at the end of the inner barrel 18 such that, as shown in cross-section A—A, a slope in the inner barrel 18 is made, namely with a 14° slope 205 as shown 202. The length of the sloping element 204 is shown as 0.375 inches. The non-sloping part 203 of the inner barrel 18 is as shown in FIG. 2.

Figure 3:
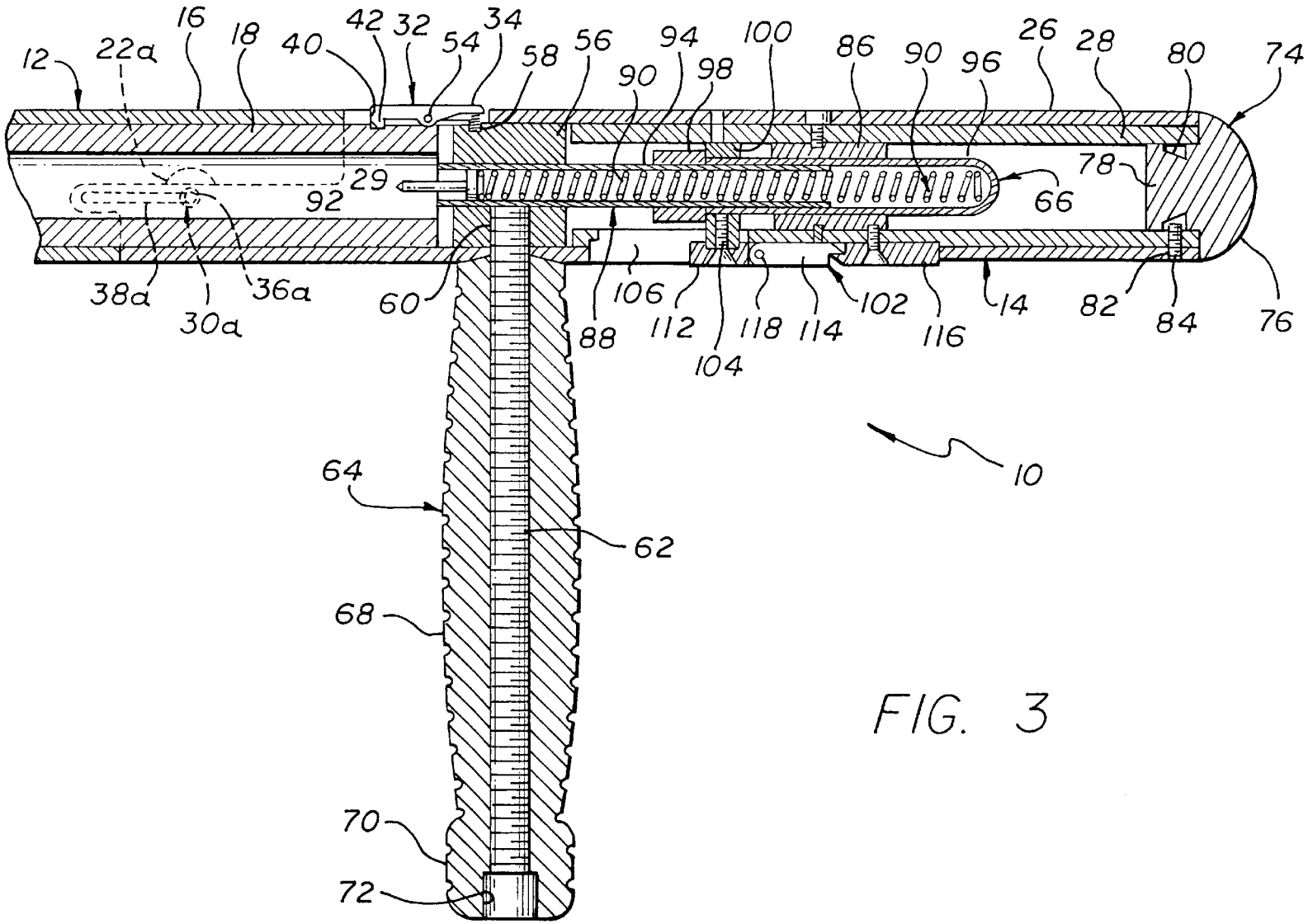
FIG. 3 shows an enlarged cross sectional view at the center and rear portion of the baton according to the present invention.
Figure 4:
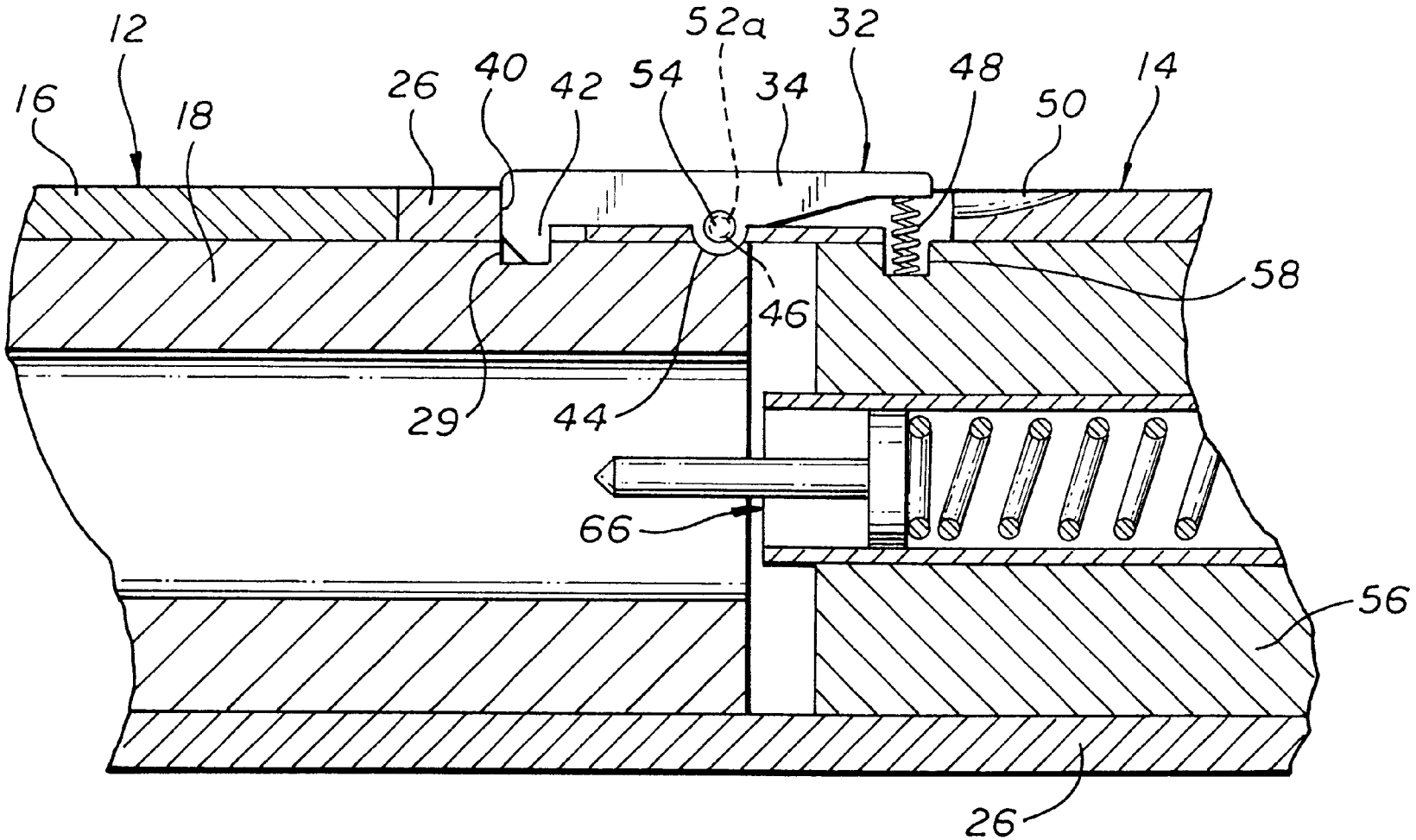
FIG. 4 shows a locking mechanism of the baton in FIG. 1.

Referring to FIGS. 3 and 4, a locking mechanism 32 is disposed on the top of the outer tubular part 26 of the rear breech body 14. A generally elliptic shape recess 40 is longitudinally formed on the top of the rear breech body 14, wherein the front end of the elliptic shape recess 40 is approximately 0.25 inches behind the cutoff edge of rear breech body 14. The elliptic recess 40 is approximately 1.0 inches long and 0.3 inches wide with its front and rear ends both semicircularly shaped. The elliptic recess 40 is approximately 0.15 inches deep at its main center portion. At a front section, the elliptic recess 40 punches through the outer tubular part 26 of the rear breech body 14 to form a front opening. Thus, the front opening has a same contour of the elliptic recess 40 that extends from its front edge till approximately 0.1875 inches rearward. Additionally, a roundly shaped rear opening is formed near the rear end of the elliptic recess 40. The rear opening has a diameter of approximately 0.13 inch through the rear breech body 14.

At a rear section, the elliptic recess 40 punches through the outer tubular part 26 of the rear breech body 14 to form a rear opening. Thus, the rear opening has a same contour of the elliptic recess 40 that extends from its front edge till approximately 0.1875 inches rearward.

The locking mechanism 32 comprises a seesaw lock 34 longitudinally housed within and slightly extending above the elliptic recess 40, as shown in FIG. 4. The seesaw lock 34 has an overall length of about 1 inch and includes a front clasp portion 42 at its front end for latching the transverse groove 29 of the inner tubular member 18 of the front barrel body 12. In the preferred embodiment, the upper surface of the seesaw lock 34 is flush with or slightly lower than the upper surface of the rear breech body 14. Thus, the seesaw lock 34 is adapted to be positioned completely within the elliptic recess 40. This design prevents the user from accidentally pressing the seesaw lock 34 to unlock the front barrel body 12 from the rear breech body 14 and, thus, provides better functionality to the user. The front clasp portion 42 extends approximately 0.1 inch vertically downward from a front bottom end of the seesaw lock 34 and has its front face gradually taper off toward its lower edge. A semicircular pivot support portion 44 extends out of the bottom surface of the seesaw lock 34 at its center body. The pivot support portion 44 of the seesaw lock 34 has a radius of approximately 0.05 inch. Near the radius center of the semicircular pivot support 44, a transverse hole 46 with a diameter of approximately 0.06 inch is formed through the seesaw lock 34. The front half of the seesaw lock 34, which is between the semicircular pivot support portion 44 and the front clasp portion 42, has a vertical thickness of approximately 0.1 inch, and the rear half of the seesaw lock 34 has a gradually diminishing vertical thickness toward the rear end, which has a thickness of approximately 0.05 inch.

The front clasp portion 42 of the seesaw lock 34 is adapted to be housed in the front opening of the elliptic recess 40, while the rear end of the seesaw lock 34 is positioned directly over the rear opening of the elliptic recess 40. The locking mechanism 32 further comprises an elastic means 48 adapted to be disposed of within the rear opening of the elliptic recess 40. The elastic means 48 presses against the rear end of the seesaw lock 34 and urges its rear end upward. As a result, the front clasp portion 42 of the seesaw lock 34 is forced down in order to lock the front barrel body 12 due to the upward pressure from the elastic means 48. In the preferred embodiment, the elastic means 48 comprises a coil spring capable of being housed within the rear opening of the elliptic recess 40. However, any other alternative elastic means suitable to be housed in the rear opening of the elliptic recess 40 and to provide upward pressure to the seesaw lock 34 may be adopted. Additionally, an oval shaped shallow recess 50 surrounding the rear end of the elliptic recess 40 is formed on the top surface of the rear breech body 14. The oval shaped recess 50 is approximately 0.375 (3/8) inch long longitudinally, approximately 0.5 inch wide transversely and approximately 0.05 inch deep. Having the oval shaped recess 50 allows the user to press the rear end of the seesaw lock 34 further down to release the front clasp portion 42 from the transverse groove 29, thereby to unlock the front barrel body 12 from the rear breech body 14.

The locking mechanism 32 is heat treated so as to give it more stability and to keep the front 42 from wearing too rapidly from rubbing against the transverse groove 29 while locking itself into place. The transverse groove 29 is also heat treated to prevent excessive wear.

A pair of transverse tunnels 52*a*, 52*b* (not shown) are positioned in-line and near the top of the rear breech body 14, perpendicular to the elliptic recess 40 and positionally corresponding to the transverse hole 46 of the seesaw lock 34. The transverse tunnels 52*a*, 52*b* each have an inner diameter of approximately 0.06 inch. A fixing means 54 is threaded through the transverse tunnels 52*a*, 52*b* and the transverse hole 46 to secure the seesaw lock 34 within the elliptic recess 40. As a result, the seesaw lock 34 is adapted to move like a teeter-totter board. In the preferred embodiment, the fixing means 54 comprises a metal rod having a diameter of approximately 0.06 inch. In alternative embodiments, other suitable materials may be used to construct the fixing means 54.

Figure 6B:
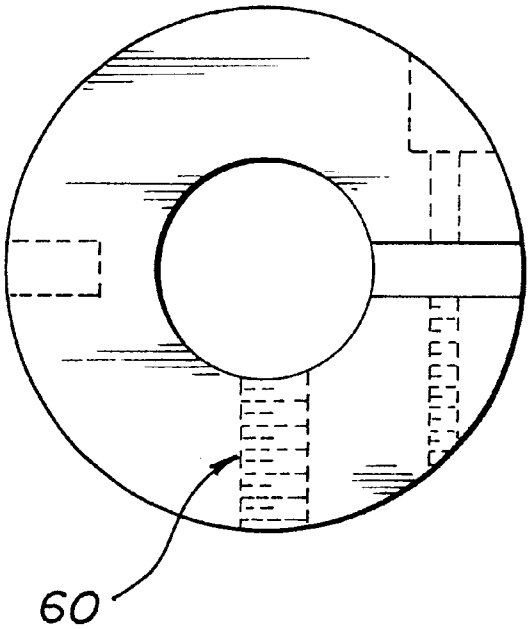
FIG. 6*b* shows a front view of the front bushing in FIG. 6*a*.
Figure 6A:
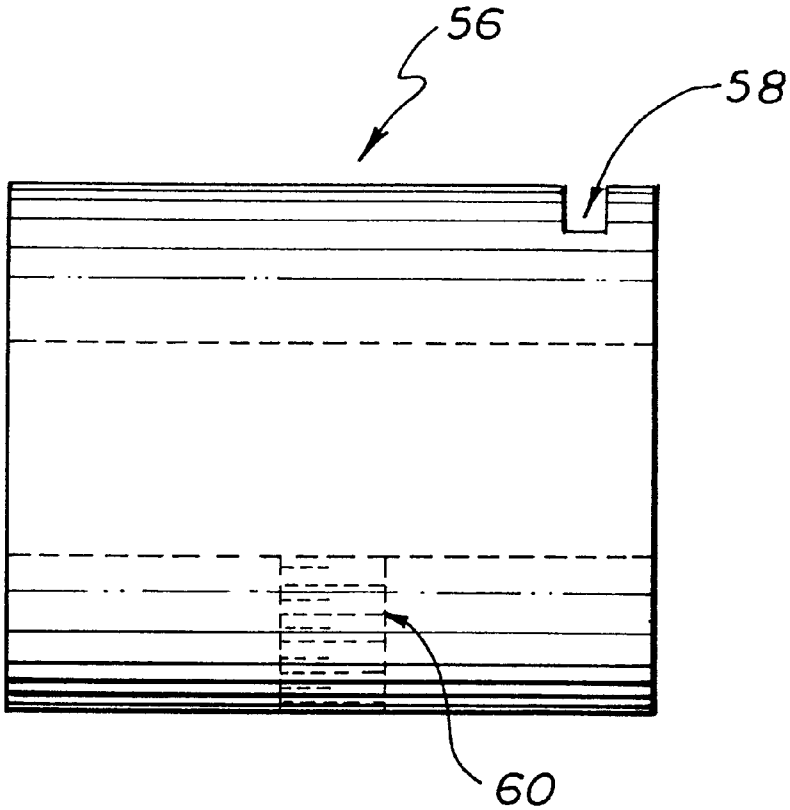
FIG. 6*a* shows a side view of a front bushing of the present invention.

A front bushing 56 is inserted within the outer tubular part 26 of the rear breech body 14 just ahead of a front end of the inner tubular part 28, and it is securely coupled to the inner periphery wall of the outer tubular part 26, as shown in FIG. 3. Referring to FIGS. 6*a* and 6*b*, the front bushing 56 is tubularly shaped and has an overall length of approximately 1 inch and an outer diameter of approximately 1 inch. The front bushing 56 has a bushing wall of approximately 0.312 (5/16) inch thick and a tunnel of approximately 0.375 inch wide in diameter extending through the front bushing 56 longitudinally. In FIG. 4, the front bushing 56 shows a rounded drill hole 58 on its top near the rear end of the front bushing 56. The drill hole 58 has a diameter of about 0.1875 inch and a depth of approximately 0.1 inch. The drill hole 58 of the front bushing 56 is positioned precisely under the rear opening of the elliptic recess 40 when mounted, so that the elastic means 48 may be housed within the drill hole 58 through the rear opening of the elliptic recess 40. Furthermore, a tap hole 60 (FIG. 3) having an approximately 0.375 (3/8) inch diameter is formed at the bottom center of the front bushing 56. The tap hole 60 is approximately 0.35 inch deep into the front bushing 56 and has screw worms on its inner wall adapted to house a fixing bolt 62 through a handle 64. The front bushing 56 is further properly shaped to hold a front portion of a firing mechanism 66, as will be explained in following paragraphs.

The handle 64 is securely and perpendicularly coupled to the bottom side of the rear breech body 14, as shown in FIG. 1. In the preferred embodiment, the handle 64 is made of aircraft grade aluminum materials, but other suitable alternative materials may be used in lieu of the aluminum. The handle 64 has a generally beer barrel shape body having narrower body width at both ends (approximately 0.98 inches) and a wider body width at the center (approximately 1.2 inches) of the body, thereby providing a better grip to the user. In addition, a plurality of circular grooves 68 surround an outer surface of the handle 64 to prevent slips of the user when using the bean bag baton 10. Each circular groove 68 is approximately 1/16 inch wide and 1/16 inch deep respectively, and is approximately 0.25 inch apart (center to center) from a next circular groove. The body of the handle 64 is formed by an encircled handle wall having a thickness of approximately 0.3 inches and enclosing an inner bore to house the fixing bolt 62. A top portion of the handle 64 has a generally semicircular contour allowing the handle 64 to tightly mesh with the bottom surface of the rear breech body 14.

A lower end of the handle 64 is a neck portion coupled to a bottom cap portion 70 of the handle 64. The bottom cap portion 70 is cylindrically shaped, having a diameter of approximately 1.2 inches of its outer periphery and a slightly curved bottom surface. A vertical opening 72 is formed through the bottom cap portion 70. Thus, the fixing bolt 62 is adapted to thread through the bottom cap portion 70 into the inner bore of the handle 64 and to be securely screwed into the tap hole 60 of the front bushing 56 for securing the handle 64 to the rear breech body 14. The fixing bolt 62 is approximately 6 inches long. In the preferred embodiment, an industrial standard bolt of the size (3/8×24) is adopted as the fixing bolt 62.

A rounded rear cap 74 caps the rear end of the rear breech body 14, as shown in FIG. 3. The rear cap 74 prevents the firing mechanism 66 of the present invention from falling off the baton 10 or accidentally "back firing" and injuring the user. The rear cap 74 has a head portion 76 integrally coupled to a neck portion 78. The head portion 76 of the rear cap 74 has a diameter of approximately 1.312 inches and a longitudinal length of about 0.5 inch, and it has a generally semi-hemispherical shape at its rear end. The semi-hemispherical shape of the head portion 76 makes the overall rear end of the bean bag baton 10 blunt to improve safety when using the baton 10. The neck portion 78 of the rear cap 74 has a diameter of approximately 0.812 inch and a longitudinal length of approximately 0.5 inch. A circular groove 80, approximately 0.21 inch wide and 0.21 inch deep, encircles the center of the periphery of the neck portion 78. A lower opening 82 is vertically formed through the lower half of the rear breech body 14 near its rear end. The lower opening 82 is correspondingly positioned on the rear breech body 14 with respect to the circular groove 80 of the rear cap 74 when mounted. The lower opening 82 has a diameter of approximately 3/16 inch and is adapted to receive a securing bolt 84 to be inserted into the circular groove 80 through the lower opening 82. Thus, the securing bolt 84 is adapted to securely couple the rear cap 74 to the rear breech body 14 at its rear end.

A rear bushing 86 is securely inserted within the rear breech body 14 approximately three and a half (3½) inches forward of the rear end. The rear bushing 86 is tubularly shaped with a bushing wall having an outer diameter of approximately 0.812 inch and an inner diameter of approximately 0.5 inch. A longitudinal tubular tunnel encircled by the bushing wall is adapted to hold the firing mechanism 66 near its rear end. Moreover, the front end of the rear bushing 86 is spaced forwardly from the rear end of the front bushing 56 by approximately 2 inches.

Figure 7:
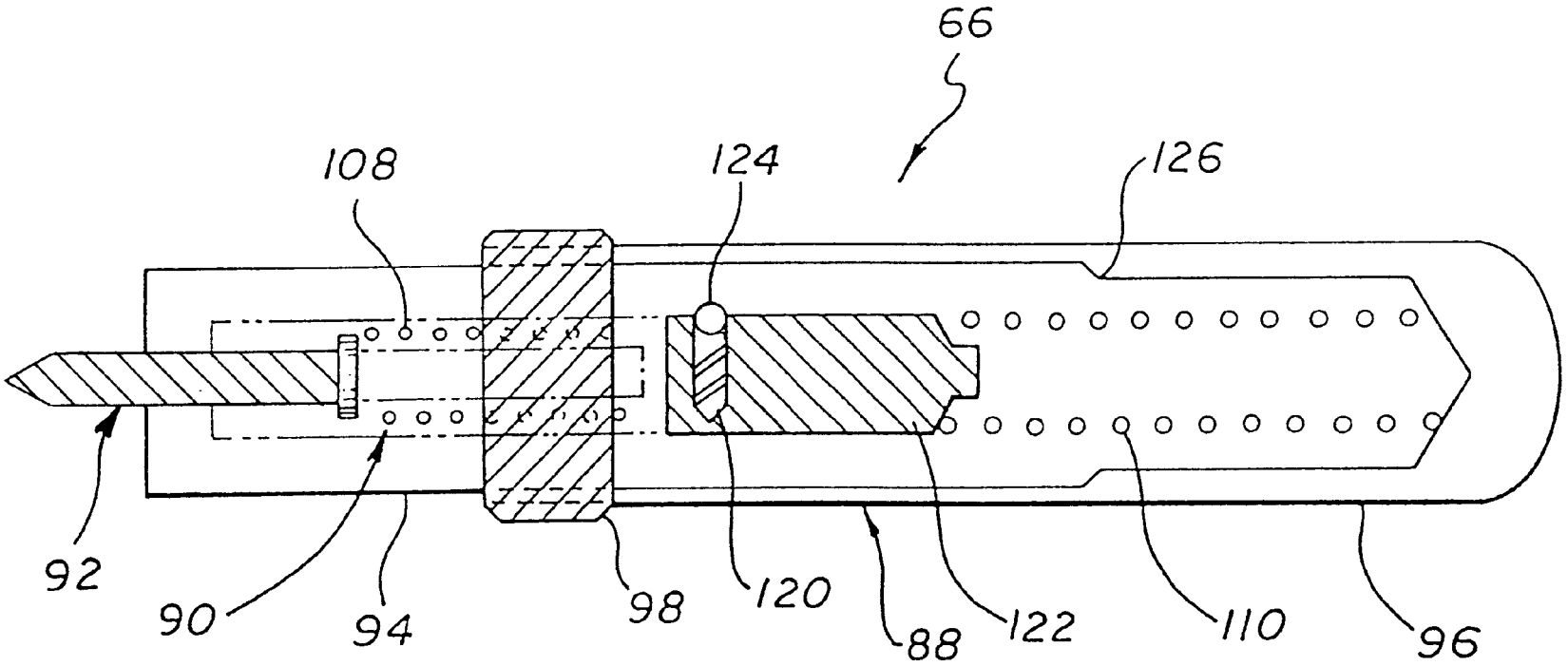
FIG. 7 shows a more detailed illustration of a preferred firing mechanism.
Figure 2A:
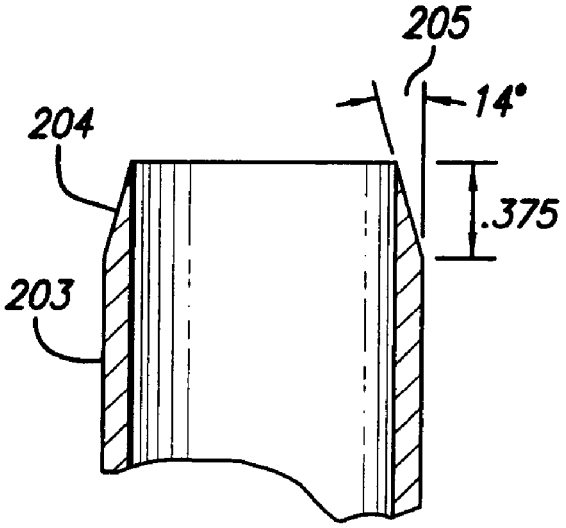
Figure 2B:
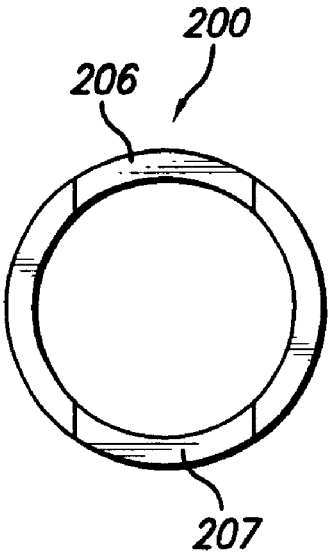

Any commercially available firing mechanism that is suitable in size and power may be used as the firing mechanism 66 according to the present invention. For instance, a firing mechanism made by a Heli-Coil Product Division of Mite Corporation of Danbury, Connecticut (Part No. 3695-3) may be used as the firing mechanism 66 of the preferred embodiment, as shown in FIG. 7. Referring to FIGS. 3 and 7, the firing mechanism 66 is held by the front and rear bushings 56, 86 in the rear breech body 14. The firing mechanism 66 has a main tubular body 88, an internal elastic mechanism 90 positioned within the main tubular body 88, and a firing pin 92 positioned at a front end of the firing mechanism 66 and coupled to the internal elastic mechanism 90. In the preferred embodiment, the internal elastic mechanism 90 comprises a front coil spring 108 and a rear coil spring 110, as shown in FIG. 7. The front end of the main tubular body 88 is approximately flush with the front bushing 56, and the firing pin 92 extends approximately 0.375 inch out of the main tubular body 88. The main tubular body 88 comprises an inner member 94 adapted to be encircled by a slidable outer member 96. The inner member 94, having a diameter of approximately 0.375 inch, is tightly encircled by the front bushing 56 at the front end. The outer member 96 has a diameter of approximately 0.5 inch and is slidably encircled by the rear bushing 86. The outer member 96 is approximately 2.625 inches long, and it slidably encircles a rear section of the inner member 94 by approximately 1.3 inch at a rest position.

A tubular stop 98 is securely coupled to the slidable outer member 96 at its front end, and the tubular stop 98 is itself slidable along the longitudinal surface of the inner member 94. A holder 100 is coupled to the outer member 96 and is adapted to push the tubular stop 98 for triggering the firing mechanism 66. The holder 100 has a head ring section and a neck section coupled to the head ring section at a bottom end. The head ring section has an outer diameter of approximately 0.75 inch and an inner diameter of approximately 0.5 inch, and the neck section is approximately ⅜ inch wide and extends approximately 0.125 inch out of the head ring section toward the bottom. Thus, the inner diameter of the holder 100 is adapted to firmly encircle the outer member 96 of the firing mechanism 66. Alternatively, one or more holes may be drilled on the rim portion of the head ring section to receive bolts for tightly securing the holder 100 to the outer member 96 of the firing mechanism 66. Moreover, a vertical receptive hole is drilled through the bottom of the neck section for receiving a bolt 104 from a trigger mechanism 102.

Figure 5A:
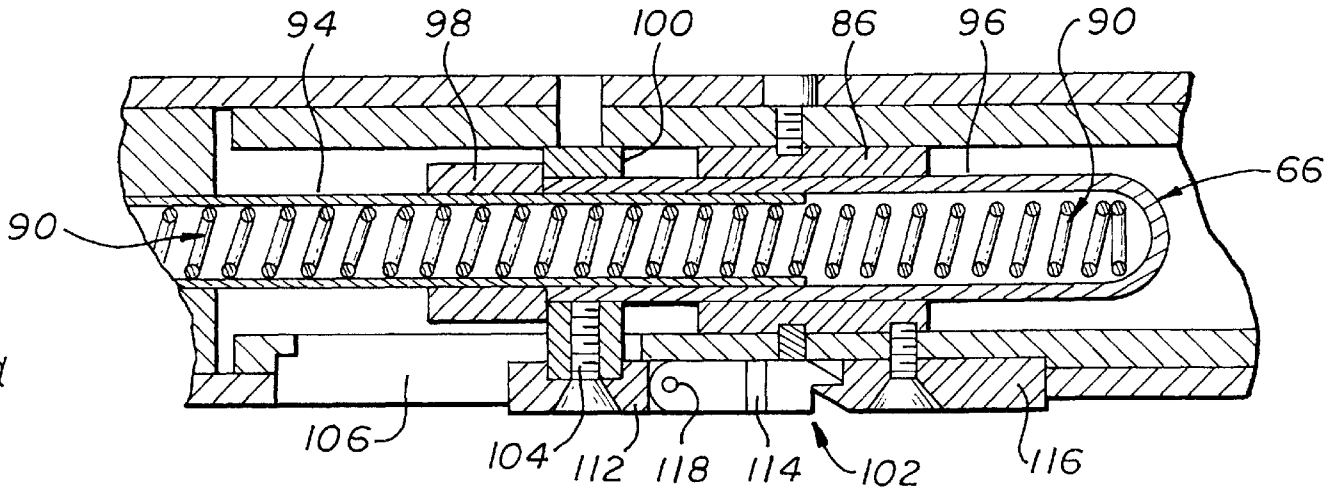
FIG. 5*a* shows a trigger mechanism of the baton in a locked position.
Figure 5B:
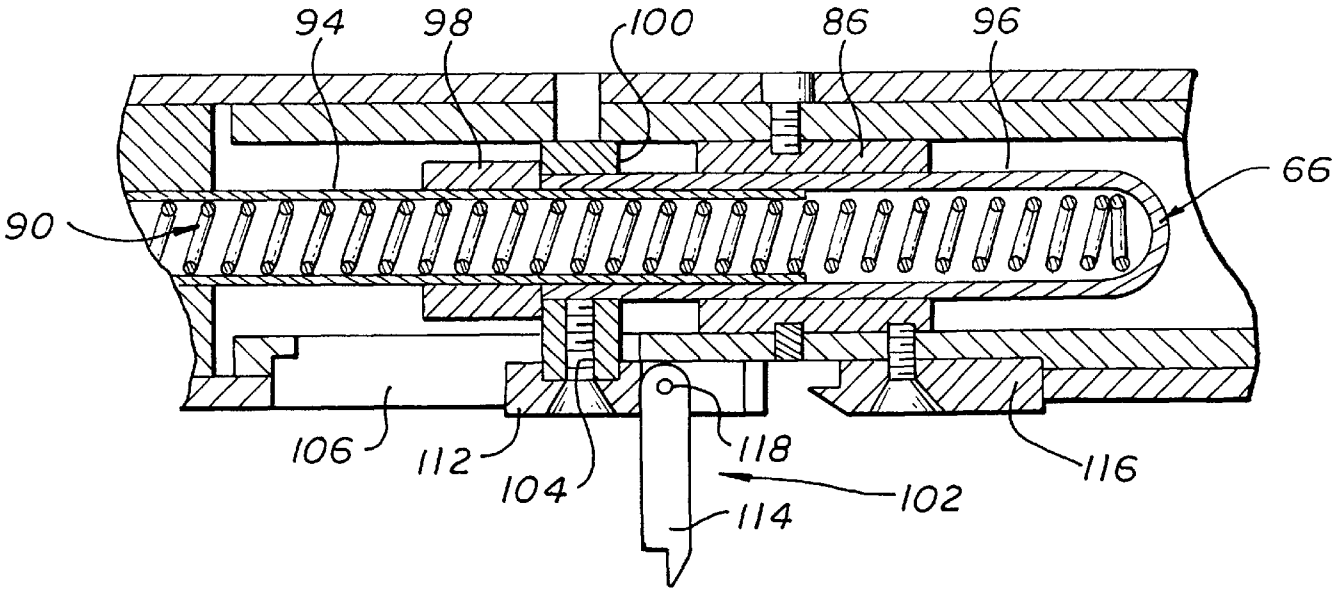
FIG. 5*b* shows the trigger mechanism of the baton in a perpendicular position.

FIGS. 5*a* and 5*b* illustrate the trigger mechanism 102 in detailed. In FIG. 5*a*, an elliptically shaped bottom recess 106 is formed on the bottom of the rear breech body 14 to accommodate the neck section of the holder 100 and the trigger mechanism 102. The bottom recess 106 is approximately 3.0 inches long and approximately 0.625 inch wide. The bottom recess 106 includes a bottom elliptic opening section, which is approximately 1.5 inches long and 0.375 inch wide and is positioned within the front end of the bottom recess 106, and a rear recess section. The rear recess section is approximately 0.2 inch deep and 1.25 inches long. FIGS. 5*a* and 5*b* and part of the FIG. 3 are also simplified drawings of the firing mechanism 66. For more detailed descriptions of the firing mechanism 66, please refer to FIG. 7.

The holder 100 is positioned immediately adjacent to the tubular stop 98 at its rear end toward the rear bushing 86. As a result, the holder 100 is adapted to push forward the tubular stop 98, which, in turn, pulls the slidable outer member 96 forward longitudinally along the inner member 94. The trigger mechanism 102 is securely coupled to the holder 100 at the bottom by inserting the bolt 104 into the vertical hole of the neck section of the holder 100. The trigger mechanism 102 comprises a base 112, a trigger plate 114 pivotally coupled to the base 112 at a rear end, and a trigger lock 116 securely coupled to the bottom recess 106 at the rear end, FIG. 5. The trigger lock 116 has a front extension section adapted to latch a rear extension section of the trigger plate 114, as shown in FIG. 5*a*. The base 112 has an overall length of approximately 0.625 inch and an overall width of approximately 0.625 inch. The base 112 has a longitudinal head part at the front end and a narrower neck part coupled to the head part at the rear end. The front end of the base 112 is semi-circularly shaped with a radius of approximately ⅛ inch. The neck part of the base 112 is approximately 0.25 inch long and 0.36 inch wide. As mentioned, the base 112 is securely coupled to the holder 100 by the bolt 104 through a vertical base hole located at the radius center of the head part. A pivot hole is transversely formed through the neck part of the base 112.

The trigger plate 114 has an overall length of approximately 1.125 inch and a width of approximately 0.625 inch. As mentioned, the trigger plate 114 has the rear extension adapted to latch the front extension of the trigger lock 116 when the trigger plate 114 is horizontally positioned during the rest position. This safety design of the present invention prevents the user from accidentally pressing the trigger plate 114 to trigger the firing mechanism 66, particularly when using the present invention as a baton in a close range combat situation. A pair of pivoting poles extend outward at the front end of the trigger plate 114. The pivoting poles of the trigger plate 114 have a through hole adapted to be positioned corresponding to the pivot hole of the base 112 for a pivot rod 118 to thread through. When unlocked from the trigger lock 116, the trigger plate 114 is adapted to be positioned perpendicularly to the rear breech body 14 for the user to press on the trigger plate 114 and trigger the firing mechanism 66. Thus, the trigger plate 114 is pivotally coupled to the base 112 by the pivot rod 118 and is adapted to be positioned perpendicularly or horizontally to the rear breech body 14.

Referring to FIG. 7, an internal elastic mechanism 90 is positioned both within the inner member 94 and the slidable outer member 96. When the slidable outer member 96 is pushed forward by the trigger plate 114, the internal elastic mechanism 90 is pressed by the slidable outer member 96. As noted, the internal elastic mechanism 90 comprises a front coil spring 108 and a rear coil spring 110. A hammer 122 is coupled to the internal elastic mechanism 120 and is adapted to be pressed by the rear coil spring 110. The hammer is adapted to move longitudinally and to forcibly impinge on the firing pin 92 to cause the firing pin 92 suddenly extending forward due to the impact.

A releasing elastic means 120 is positioned within a slot near the front end of the hammer 122. In the preferred embodiment, the releasing elastic means 120 is a coil spring. Alternatively, any other suitable elastic means may be used for the releasing elastic means 120. Moreover, a ball 124 is disposed of in the slot above the releasing elastic means 120 and is adapted to press the releasing elastic means 120 downward. The ball 124 is adapted to move vertically in the slot and is urged approximately halfway outward of the slot by the releasing elastic means 120 during a rest position. When the pulling stop 98 pulls the outer member 96 forward the rear coil spring 110 is compressed against the hammer 122. When the ball 124 reaches a point 126 of the outer member 96, the ball 124 is pressed downward by the outer member 96 to urge the releasing elastic means 120 releasing the hammer 122 and causing the hammer 122 to impinge on the firing pin 92. When the hammer 122 hits the firing pin 92 that causes the firing pin 92 to suddenly move forward, the firing pin 92 may hit a cartridge of a projectile to cause an explosion of the cartridge, thereby causing the projectile to be projected outward of the baton 10 due to an explosive pressure.

As previously described, the firing mechanism 66 is uniquely designed that it has to be pressed forward to fire, as compared to most conventional weapon systems whose triggers have to be pulled backward to fire. Furthermore, there is no load on the internal elastic mechanism 90 until the trigger plate 114 and, thus, the outer member 96 of the firing mechanism 66 are pressed forward. As stated, the internal elastic mechanism 90 includes a front coil spring 108 and a rear coil spring 110, so both the front coil spring 108 and the rear coil spring 110 have no load prior to be pressed. Thus, the present invention provides additional safety advantage over the conventional batons. Namely, the bean bag baton 10 of the present invention will not go off accidentally according to the present invention.

From the foregoing, it will be appreciated that, although specific embodiments of the invention have been described herein for purposes of illustration, various modifications may be made by persons skilled in the art without deviating from the spirit and/or scope of the invention. Particularly, all dimensions of the present invention may be adjusted to accommodate different sizes of various members of the present invention. Moreover, other types or shapes of the trigger mechanism may be used, so long as it provides similar locking and/or pressing functionality of the present invention.

While the invention herein disclosed has been described by means of specific embodiments and applications thereof, numerous modifications and variations could be made thereto by those skilled in the art without departing from the scope of the invention set forth in the claims.

What is claimed is:

1. An apparatus for launching a projectile including a barrel body, a breech body pivotally coupled at one end to the barrel body, a handle coupled at one end to the breech body, a firing mechanism including a first tubular member securely coupled within the breech body and having a spring-loaded firing pin at a front end, a second tubular member slidably coupled within the breech body proximate to a back end of the first tubular member and adapted to slide longitudinally over the first tubular member, a tubular stop securely coupled to a front end of the second tubular member between the front and back ends of the first tubular member within the breech body, and a spring-loaded hammer disposed within the second tubular member and adapted to forcibly impinge on the spring-loaded firing pin of the first tubular member when the second tubular member is slidably pulled forward over the first tubular member toward the firing pin from a first uncocked position to a second cocked position, said apparatus characterized by a trigger base coupled to the second tubular member and adapted to push the tubular stop forward toward the firing pin, a trigger plate pivotally coupled at one end to said trigger base and adapted to pivot relative to the breech body between a first substantially horizontal position in which said trigger plate is at rest and a second substantially vertical position for pushing the tubular stop forward toward the firing pin to trigger the firing mechanism, and a trigger lock securely coupled to the breech body opposite said trigger base for latching said trigger plate when said trigger plate is in said first position.

2. The apparatus of claim 1, further comprising means for coupling said trigger base to the second tubular member.

3. The apparatus of claim 2, wherein said coupling means includes a holder having a head ring portion coupled to the second tubular member behind the tubular stop within the breech body and adapted to push the tubular stop forward toward the firing pin and a neck portion coupled to said trigger base.

4. The apparatus of claim 1, further comprising a locking mechanism adapted to removably lock the barrel body to the breech body before launching the projectile.

5. The apparatus of claim 4, wherein said locking mechanism comprises a seesaw lock adapted to pivot in a recess disposed on the breech body proximate to the pivotally coupled barrel body and having a front clasp section adapted to latch a corresponding groove on the rear end of the barrel body and a spring-loaded back section for urging said front clasp section toward the interior of the breech body to latch said groove on the barrel body.

6. The apparatus of claim 1, further comprising a rear cap coupled to an opposite end of the breech body to prevent the firing mechanism from accidentally back-firing during use.

7. The apparatus of claim 1, further comprising a front bushing mounted inside the breech body and adapted to securely couple a front end of the first tubular member.

8. The apparatus of claim 7, further comprising a rear bushing mounted inside the breech body away from said front bushing and adapted to slidably couple the second tubular member within the breech body.

9. An apparatus for launching a projectile including a barrel body, a breech body pivotally coupled at one end to the barrel body, a handle coupled at one end to the breech body, a firing mechanism including a first tubular member securely coupled within the breech body and having a spring-loaded firing pin at a front end, a second tubular member sidably coupled within the breech body proximate to a back end of the first tubular member and adapted to slide longitudinally over the first tubular member, a tubular stop securely coupled to a front end of the second tubular member between the front and back ends of the first tubular member within the breech body, and a spring-loaded hammer disposed within the second tubular member and adapted to forcibly impinge on the spring-loaded firing pin of the first tubular member when the second tubular member is slidably pulled forward over the first tubular member toward the firing pin from a first uncocked position to a second cocked position, said apparatus characterized by:

(a) a holder having a head ring portion coupled to the second tubular member behind the tubular stop within the breech body and adapted to push the tubular stop forward toward the firing pin and a neck portion;

(b) a trigger base coupled to said neck portion of said holder and adapted to push the tubular stop forward toward the firing pin; and (c) a trigger plate pivotally coupled at one end to said trigger base and adapted to pivot relative to the breech body between a first substantially horizontal position in which said trigger plate is at rest and a second substantially vertical position for pushing the tubular stop forward toward the firing pin to trigger the firing mechanism.

10. The apparatus of claim 9, further comprising a trigger lock securely coupled to the breech body opposite said trigger base and adapted to latch said trigger plate when said trigger plate is in said first position.

11. The apparatus of claim 10, further comprising an elongated aiming groove disposed on the barrel body.

12. The apparatus of claim 11, wherein said aiming groove is adapted to improve the aiming visibility for an user.

13. An apparatus for launching a projectile including a barrel body, a breech body pivotally coupled at one end to the barrel body, a handle coupled at one end to the breech body, a firing mechanism including a first tubular member securely coupled within the breech body and having a spring-loaded firing pin at a front end, a second tubular member slidably coupled within the breech body proximate to a back end of the first tubular member and adapted to slide longitudinally over the first tubular member, a tubular stop securely coupled to a front end of the second tubular member between the front and back ends of the first tubular member within the breech body, and a spring-loaded hammer disposed within the second tubular member and adapted to forcibly impinge on the spring-loaded firing pin of the first tubular member when the second tubular member is slidably pulled forward over the first tubular member toward the firing pin from a first uncocked position to a second cocked position, said apparatus characterized by:

(a) a holder having a head ring portion coupled to the second tubular member behind the tubular stop within the breech body and adapted to push the tubular stop forward toward the firing pin and a neck portion;

(b) a trigger base coupled to said neck portion of said holder and adapted to push the tubular stop forward toward the firing pin;

(c) a trigger plate pivotally coupled at a front end to said trigger base and adapted to pivot relative to the breech body between a first substantially horizontal position in which said trigger plate is at rest and a second substantially vertical position for pushing the tubular stop forward toward the firing pin to trigger the firing mechanism; and (d) a trigger lock securely coupled to the breech body opposite said trigger base and having a front section adapted to latch a back end of said trigger plate when said trigger plate is in said first substantially horizontal position to prevent accidental triggering of the firing mechanism.

14. The apparatus of claim 13, wherein said back end of said trigger plate is adapted to latch said front section of said trigger lock.

15. An apparatus for launching a projectile including a barrel body, a breech body pivotally coupled at one end to the barrel body, a handle coupled at one end to the breech body, a firing mechanism including a first tubular member securely coupled within the breech body and having a spring-loaded,firing pin at a front end, a second tubular member slidably coupled within the breech body proximate to a back end of the first tubular member and adapted to slide longitudinally over the first tubular member, a tubular stop securely coupled to a front end of the second tubular member between the front and back ends of the first tubular member within the breech body, and a spring-loaded hammer disposed within the second tubular member and adapted to forcibly impinge, on the spring-loaded firing pin of the first tubular member when the second tubular member is slidably pulled forward over the first tubular member toward the firing pin from a first uncocked position to a second cocked position, said apparatus characterized by:

(a) a holder having a head ring portion coupled to the second tubular member behind the tubular stop within the breech body and adapted to push the tubular stop forward toward the firing pin and a neck portion;

(b) a trigger base having a substantially semi-circular head section securely coupled to said neck portion of said holder and adapted to push the tubular stop forward toward the firing pin and a neck section; and (c) a trigger plate pivotally coupled at one end to said neck section of said trigger base and adapted to pivot relative to the breech body between a first substantially horizontal position in which said trigger plate is at rest and a second substantially vertical position for pushing the tubular stop forward toward the firing pin to trigger the firing mechanism.

16. The apparatus of claim 15, further comprising a trigger lock securely coupled to the breech body opposite said trigger base and adapted to latch said trigger plate when said trigger plate is in said first position.

* * * * *

UNITED STATES PATENT AND TRADEMARK OFFICE

CERTIFICATE OF CORRECTION

PATENT NO. : 6,463,688 B1
DATED : October 15, 2002
INVENTOR(S) : Russell Idehara It is certified that error appears in the above-identified patent and that said Letters Patent is hereby corrected as shown below:

Drawings,
Please delete Sheet 2, FIGS. 2A and 2B and replace with attached new drawing.

Column 2,
Line 67, after "position for loading.", insert

--FIG. 2A is a cross-sectional view along section line A-A of FIG. 2 of a mechanism incorporated into an inner barrel of the baton of FIG. 1, to aid in the removal of a spent round; FIG. 2B is a top plan view along line B-B of FIG. 2 of a mechanism incorporated into an inner barrel of the baton of FIG. 1, to aid in the removal of a spent round;--

Column 7,
Line 38, delete the paragraph beginning with "Referrring to FIG. 2, a mechanism 200, 201, 202 is incorporated" and ending with "as shown in FIG. 2.", line 47, and substitute the following paragraph therefor:

--Referring to FIGS. 2A and 2B, a mechanism 200 is incorporated into inner barrel 18 to aid in the removal of a spent round. The rim of the spent round may be grasped by the tips or nails of two fingers. As shown in the top plan view of FIG. 2B, slots 206 and 207 are disposed at the end of inner barrel 18 such that, as shown in the cross-sectional view of FIG. 2A taken along line A-A of FIG. 2, a slope in inner barrel 18 is made, namely with a 14° slope 205. The length of sloping element 204 is shown as 0.375 inches. The non-sloping part 203 of the inner barrel 18 is as shown in FIG. 2A.--

Signed and Sealed this

Twentieth Day of July, 2004

JON W. DUDAS
*Acting Director of the United States Patent and Trademark Office*